US012037784B2

(12) United States Patent
Berg

(10) Patent No.: US 12,037,784 B2
(45) Date of Patent: Jul. 16, 2024

(54) BUILDING CONNECTION COMPRISING A FIRST BUILDING ELEMENT AND A SECOND BUILDING ELEMENT

(71) Applicant: Svein Berg Holding AS, Åndalsnes (NO)

(72) Inventor: Svein Berg, Isfjorden (NO)

(73) Assignee: Svein Berg Holding AS, Åndalsnes (NO)

( * ) Notice: Subject to any disclaimer, the term of this patent is extended or adjusted under 35 U.S.C. 154(b) by 130 days.

(21) Appl. No.: 17/792,900

(22) PCT Filed: Feb. 2, 2021

(86) PCT No.: PCT/EP2021/052369

§ 371 (c)(1),
(2) Date: Jul. 14, 2022

(87) PCT Pub. No.: WO2021/156226

PCT Pub. Date: Aug. 12, 2021

(65) Prior Publication Data

US 2023/0067965 A1 Mar. 2, 2023

(30) Foreign Application Priority Data

Feb. 3, 2020 (NO) ..... 20200131

(51) Int. Cl.
*E04B 1/61* (2006.01)
*E04B 1/38* (2006.01)
(Continued)

(52) U.S. Cl.
CPC ..... *E04B 1/6125* (2013.01); *E04B 1/388* (2023.08); *E04B 1/84* (2013.01); *E04B 2001/6195* (2013.01); *E04B 2001/8254* (2013.01)

(58) Field of Classification Search
CPC ..... E04B 1/6125; E04B 1/388; E04B 1/84; E04B 2001/6195; E04B 2001/8254;
(Continued)

(56) References Cited

U.S. PATENT DOCUMENTS 5,862,634 A 1/1999 Berger et al.
2017/0009443 A1 1/2017 Berg

FOREIGN PATENT DOCUMENTS

CN 102395735 A 3/2012
CN 103282587 A 9/2013
(Continued)

OTHER PUBLICATIONS

International Search Report issued in PCT/EP2021/052369 on May 10, 2021 (5 pages).
(Continued)

*Primary Examiner* — Patrick J Maestri
(74) *Attorney, Agent, or Firm* — Osha Bergman Watanabe & Burton LLP

(57) ABSTRACT

A building connection includes a first building element and a second building element arranged at a distance from each other. The first building element is connected to the second building element by at least one connecting device. The connecting device includes a load transfer element arranged in the first building element, and a support box molded into the second building element. The support box includes an inner bottom wall surface and a support box opening facing the first building element. The connecting device further includes a first sound-absorbing element arranged on the inner bottom wall surface of the support box, and a support plate which is arranged on top of the first sound-absorbing element. The load transfer element protrudes from the first building element and into the support box through the support box opening. A filling area is molded with a filling material. The filling area includes the support box and an area between the first building element and the second building element.

13 Claims, 7 Drawing Sheets

(51) Int. Cl.
*E04B 1/84* (2006.01)
*E04B 1/82* (2006.01)

(58) Field of Classification Search
CPC .... E04B 1/483; E04B 1/48; E04B 1/82; E04F 2011/0212; E04F 11/02; E04F 11/022
USPC ..... 52/167.7, 167.9
See application file for complete search history.

(56) References Cited

FOREIGN PATENT DOCUMENTS

| | | | |
|---|---|---|---|
| CN | 103924770 | A | 7/2014 |
| CN | 107034998 | A | 8/2017 |
| CN | 207974290 | U | 10/2018 |
| DE | 8713222 | U1 | 11/1987 |
| DE | 4409477 | A1 | 9/1995 |
| DE | 19502711 | A1 | 10/1996 |
| DE | 19602306 | A1 | 7/1997 |
| DE | 19700765 | A1 | 7/1998 |
| DK | 0685613 | T3 | 9/1999 |
| EP | 3023555 | A1 | 5/2016 |
| KR | 102071825 | B1 | 1/2020 |
| NO | 337777 | B1 | 6/2016 |

OTHER PUBLICATIONS

Written Opinion of the International Searching Authority issued in PCT/EP2021/052369 on May 10, 2021 (7 pages).
International Preliminary Report on Patentability from PCT/EP2021/052369 mailed on May 12, 2022 (15 pages).
Norwegian Search Report issued in NO 20200131 mailed on Aug. 31, 2020 (2 pages).
Office Action issued in counterpart Chinese Patent Application No. 202180011658.0 mailed on Jul. 31, 2023 (12 pages).
Office Action issued in the Singapore Application No. 11202250785R, mailed on Oct. 18, 2023 (9 pages).

A-A

BUILDING CONNECTION COMPRISING A FIRST BUILDING ELEMENT AND A SECOND BUILDING ELEMENT

The present application relates to a building connection where a first building element is connected to a second building element and where the building connection is arranged with sound-absorbing means to avoid and/or reduce the transfer of sound, in particular step sound, between the first and the second building element.

It is common today to use prefabricated building elements when building both large and small buildings. Different types of building elements such as wall elements, floor elements, stair elements, etc. are then produced in factories that are adapted for the production of different building elements, and the established building elements are transported to the construction site where they are installed as respective parts of a building being built there.

The prefabricated building elements are usually made of concrete. Concrete is known for transferring sound well, and one therefore wants to reduce the sound that occurs somewhere in a building, propagates through the concrete structure in the building and causes disturbances, irritation and problems for people who live, work or visit the building.

The object of the present invention has thus been to provide a building connection in which the transfer of sound between two building elements is eliminated or at least reduced in relation to known connections between building elements of concrete.

This object is achieved with a building connection and uses of the building connection as defined in the independent claims. Further, preferred embodiments of the building connection are defined in the dependent claims.

There is thus provided a building connection comprising a first building element and a second building element which are arranged at a distance from each other where the first building element is connected to the second building element by at least one connecting device. The connecting device comprises a load transfer element arranged in the first building element, and a support box which is molded into the second building element and comprises an inner bottom wall surface and a support box opening facing the first building element. The connecting device further comprises a first sound-absorbing element which is arranged on the inner bottom wall surface of the support box, and a support plate which is arranged on top of the first sound-absorbing element. Furthermore, the load transfer element protrudes from the first building element and into the support box through the support box opening, and a filling area, comprising the support box and an area between the first building element and the second building element, is molded with a filling material.

The installation order of the load transfer element and the support box in the first and the second building element, respectively, may be; the load transfer element is installed in the first building element and then the support box is molded in the second building element. Alternatively, the installation order may be the reverse; the support box is molded in the second building element and then the load transfer element is installed in the first building element.

The first building element is typically a floor element, a landing or another substantially horizontally lying building element, while the second building element is typically a wall element, a stair shaft or another substantially vertically standing building element.

With this building connection, the connecting device will be able to transfer loads between the two building elements and at the same time the transfer of sound, especially step sound, is eliminated or at least greatly reduced.

The load transfer element is preferably movable, or telescopically, arranged in a load transfer element box, where the load transfer element box is molded into the first building element. This makes it possible to insert the first building element, which typically comprises a floor element or landing, between two or more other building elements which are set up, while the movable, or telescopic, load transfer element is in a retracted position in a load transfer element box which is molded into the first building element. When the first building element is in the right position, the movable, or telescopic, load transfer element is pulled out of the load transfer element box and to its extended position where it projects into the support box in the second building element.

The first sound-absorbing element preferably covers substantially the entire inner bottom wall surface of the support box. Furthermore, the first sound-absorbing element preferably comprises an upper surface where the support plate substantially covers the entire upper surface. That is, the support plate covers substantially the entire horizontal extent of the upper surface of the first sound-absorbing element.

The first sound-absorbing element is preferably formed in a rubber material, but may also be formed in another material which provides sufficient sound attenuation, especially step sound, and at the same time withstands the mechanical stress that occurs when the weight of the first building element is transferred via the at least one load transfer element.

The first sound-absorbing element comprises an upper surface and a lower surface where the upper surface and/or the lower surface is formed with a plurality of protruding elements where the protruding elements are separated from each other.

The protruding elements may have many different designs. For example, they may be formed as knobs projecting up from the upper surface of the first sound-absorbing element and/or protruding down from the lower surface of the first sound-absorbing element. The knobs may have a cross-sectional shape that is square, rectangular, circular, polygonal or another shape. Alternatively, the protruding elements may have a cross-sectional shape which is elongate and substantially rectangular and which extends over a larger part or almost the entire surface in which they are arranged. The protruding elements may optionally have a design which is a mixture of different shapes, e.g. a mixture of the shapes mentioned above, such as rectangular protruding elements extending along the edges and smaller, knob-shaped protruding elements within them. A person skilled in the art will of course understand that there are also many other possibilities for designing the protruding elements.

The advantage of designing the upper surface and/or the lower surface of the first sound-absorbing element with a plurality of protruding elements, and thereby open areas between the plurality of the protruding elements, is that the protruding elements may be compressed and expand into the areas between the protruding elements. Therefore, the area between the plurality of protruding elements is preferably large enough to allow the plurality of protruding elements to expand outwardly and fill the space between the protruding elements when the first sound-absorbing element is subjected to load from the load transfer element via the filling material and the support plate in the support box.

The load transfer element is preferably arranged in the support box enclosed by the filling material, i.e. the load transfer element is arranged with filling material around it on all edges. The filling material may, for example, be a cement-based mortar. In this case, it means that the load transfer element is not in direct contact with the support box or support plate located on the first sound-absorbing element.

The support box is preferably formed with a plurality of side walls which are inclined relative to the inner bottom wall surface. This means that the side walls form an angle that is less than 90 degrees with the bottom wall and the inner bottom wall surface. The side walls preferably incline inwards from the bottom wall and upwards towards the roof wall of the support box.

Furthermore, the side walls of the support box are preferably formed with inner side surfaces which are smooth. This means that the side walls do not have any kind of elements protruding from the surfaces or any depressions in the surfaces that the filling material may get stuck in. This means that when the filling material in the support box hardens/dries, and thus may shrink somewhat, the filling material will not stick in the side surfaces of the side walls.

It also means that when a load is transferred from the first building element to the second building element via the load transfer element, and the first sound-absorbing element is compressed a certain distance, the hardened filling material will be able to move freely relative to the plurality of side surfaces of the support box. When this happens, a small gap is formed between the filling material and the inner side surfaces, since the inner side surfaces are inclined, which also contributes to damping the sound transfer between the first building element and the second building element.

The support box is preferably made of a plastic material, for example HDPE (high density polyethylene). The connecting device comprises the support box in order to avoid getting concrete against concrete when the filling material is placed in the filling area. If one only had a recess or pocket in the second building element into which the load transfer element was to be inserted, it would have become concrete against concrete when the filling area, i.e. among other things the area in the recess/pocket around the load transfer element, is filled with filling material. This works poorly when the first sound-absorbing element is compressed by the load transfer element and the filling material is forced to follow the load transfer element. The connecting device therefore comprises the support box, which is preferably molded into the second building element and is formed of plastic or another material to which the filling material will not adhere to in an appreciable degree.

The connecting device further preferably comprises a second sound-absorbing element which is arranged in a first end surface of the first building element facing the second building element, which second sound-absorbing element encloses an opening in the load transfer element box from which the load transfer element projects and has an extension in the first end surface of the first building element so that the second sound-absorbing element at least covers the filling area which abuts the first building element. There be no filling material will be abutting the first end surface of the first building element outside the second sound-absorbing element. Thus, there will be no concrete-to-concrete contact between the first building element and the second building element and the transfer of sound, and especially step sound, between the two building elements is eliminated or at least reduced to a minimum.

The building connection preferably comprises a sealing element which is arranged between and abuts against the first building element and the second building element, and extends at least on the underside of and up on the sides of the opening of the load transfer element box. Preferably, the sealing element abuts the second sound-absorbing element, so that direct contact between the filling material and the concrete in the first building element is avoided. This sealing element will act as bottom and side walls in the filling area located in the space between the first building element and the second building element, so that liquid filling material may be poured into the filling area without flowing out below the gap between the first building element and the second building element.

Furthermore, the area, or gap, between the first building element and the second building element, on the upper side of the filling area, or the filling areas when the first building element and the second building element are connected to two or more connecting devices, comprises a seal. This seal will prevent various liquids, dirt and the like from falling into the space or gap between the first building element and the second building element. The seal may advantageously be laid so that it more or less aligns with an upper surface of the first building element. The seal may, for example, be of silicone or another suitable material.

The building connection described herein may be used for joining a first building element and a second building element. For example, the building connection may be used when the first building element is a landing and the second building element is a wall, or when the first building element is a floor element and the second building element is a wall.

An embodiment of the present invention will now be described in more detail with reference to the accompanying figures, in which.

It should first be noted that the various features of the illustrated embodiment of the invention have the same reference numerals in all the figures. A specific reference number thus refers to the same technical features in all the figures.

Figure 1:
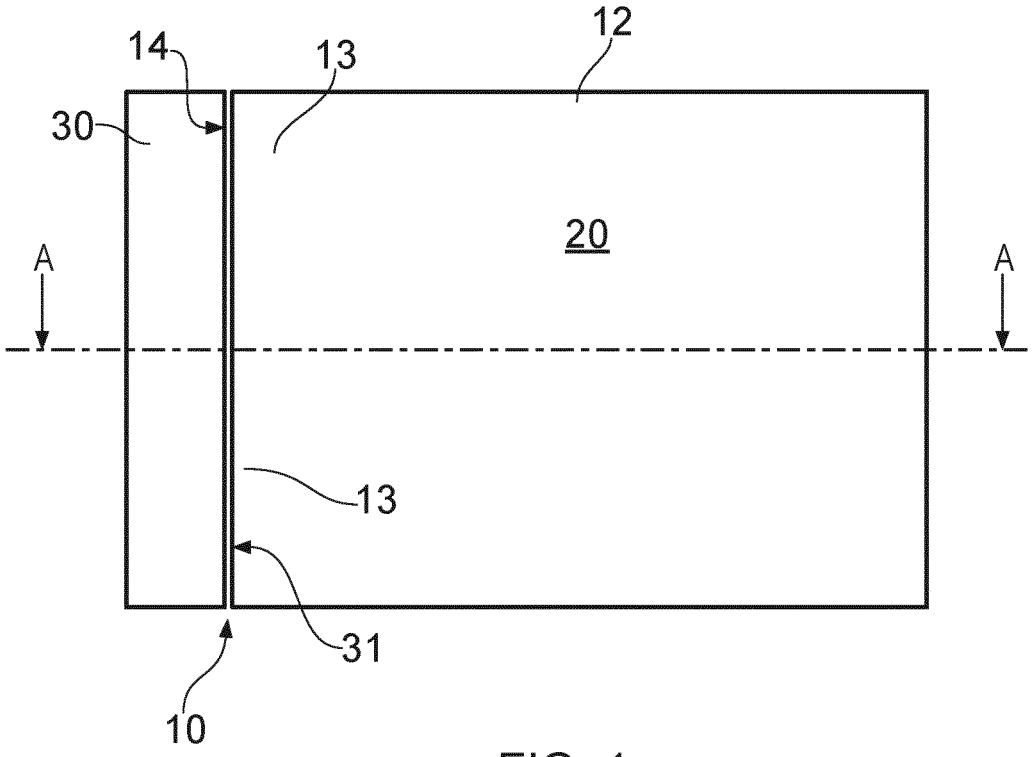
FIG. 1 shows a view of a building connection seen from above comprising a first building element and a second building element which are connected to each other.

FIGS. 1-8 show an embodiment of the building connection 10 where a first building element 12 is securely connected to a second building element 30 with at least one, but preferably a plurality of connecting devices 15. As indicated in the figures, the first building element 12 is at a distance from the second building element 30. This distance, or gap, is not large, but it is large enough that there is no direct contact between the first building element 12 and the second building element 30 which would give a good transfer of sound between the two the building elements. Typically, the second building element 30 will be a vertical wall element of one type or another, while the first building element will typically be a building element which extends outwards in the horizontal direction, such as a landing or a floor element, and which is attached to the second building element by means of one or more connecting devices 15. The weight of the first building element 12 and possible load on the first building element 12, such as furniture, persons, etc., is transferred via the connecting devices 15 to the second building element 30. As sounds propagate easily through concrete structures, the present building connection 10 is designed to eliminate transfer of sound, in particular step sound, between the first and second building elements 12, 30, or at least reduce transfer of sound between the first and second building elements 12, 30 to a minimum.

The first building element 12 has an upper surface 20, a first end portion 13 towards the second building element 30 and a first side surface 14 facing the second building element 30. The second building element 30 comprises a first side surface 31 facing the first side surface 14 of the first building element 12.

Figure 2:
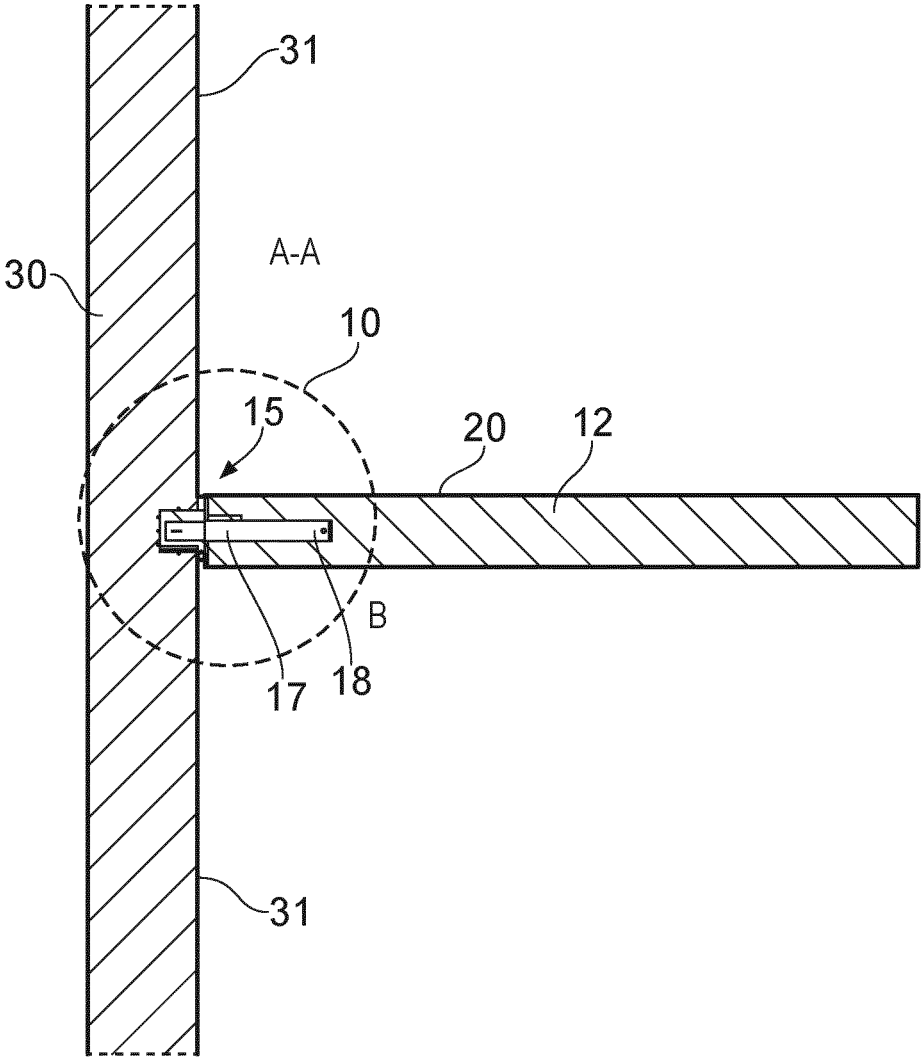
FIG. 2 shows the section A-A through the building connection shown in FIG. 1.
Figure 3:
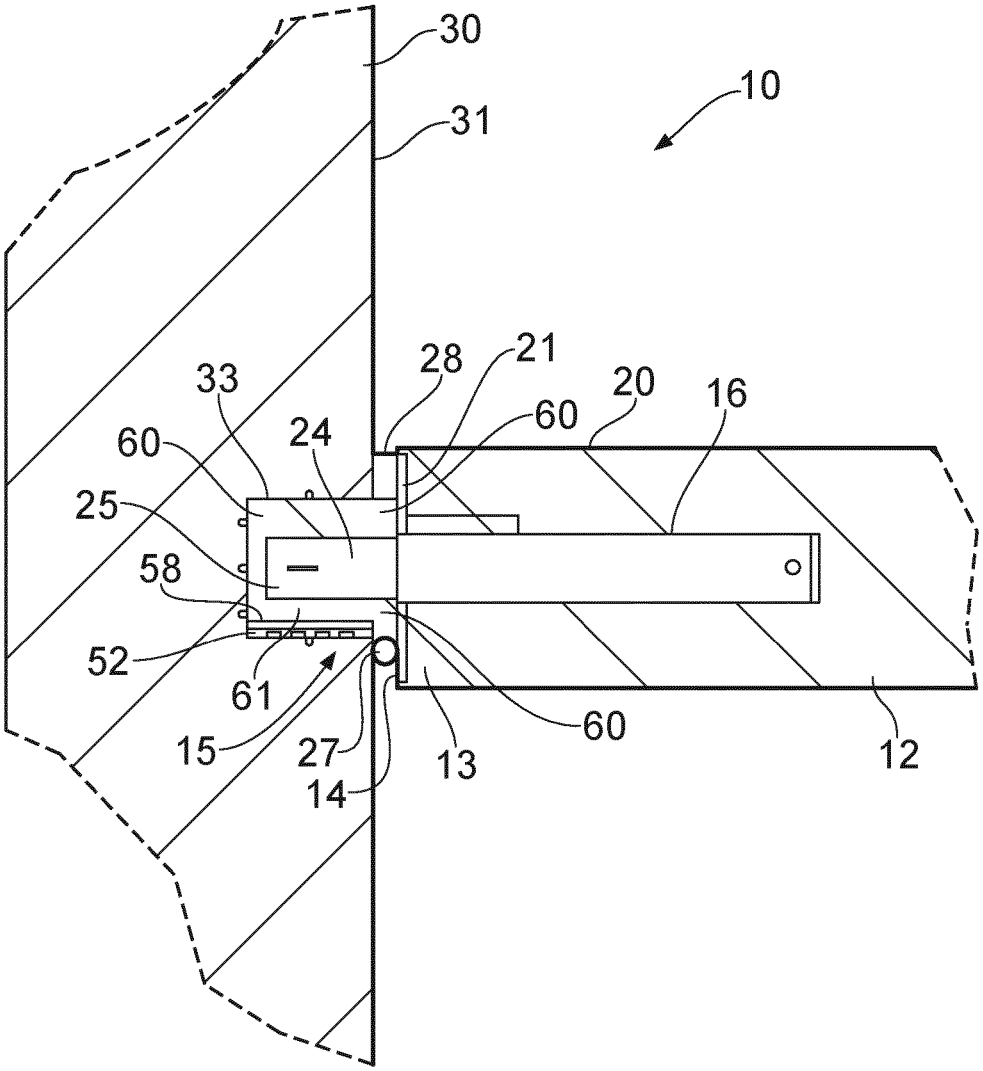
FIG. 3 shows the detail B of the building connection shown in FIG. 1 where a load transfer element protrudes from a first building element and into a support box which is molded into a second building element and where the support box is arranged with a sound-absorbing element.
Figure 4:
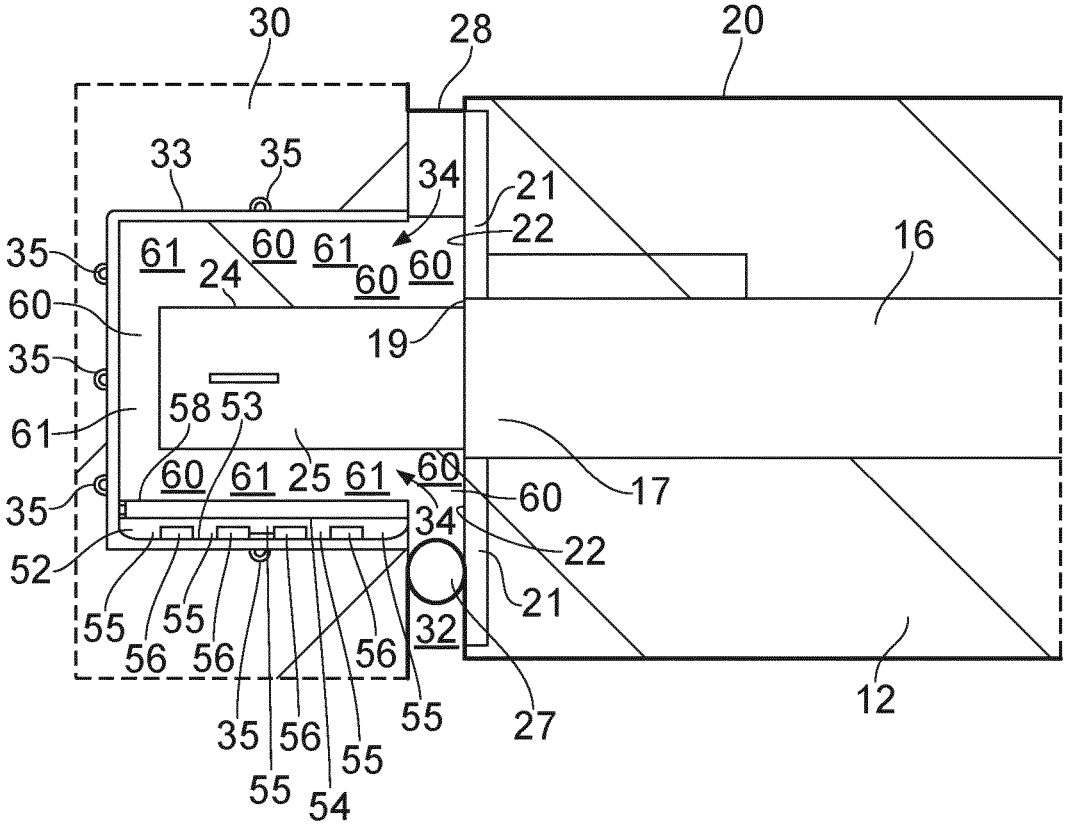
FIG. 4 shows an enlarged section of FIG. 3 which clearly shows the connecting device which connects the first building element and the second building element.

Each connecting device 15 comprises a load transfer element 24 which is arranged in the first building element 12 and projects from the first side surface 14 of the first building element 12 in an established building connection 10 as indicated in FIGS. 2-4.

The load transfer element 24 may be molded into the first building element 12 so that it is firmly anchored in the first building element 12. Alternatively, the load transfer element 24 may be movably arranged in a load transfer element box 16 between a retracted position, where preferably the entire load transfer element 24 is positioned inside the load transfer element box 16 and an extended position, wherein the load transfer element 24 is partially pulled out of the load transfer element box 16.

The load transfer element box 16 is formed with a first end portion with an opening 19 as indicated in FIG. 4, and is preferably fixedly attached in the first building element 12. The load transfer element box 16 may for instance advantageously be molded into the first building element 12 during the production of the first building element 12.

The opening 19 of the load transfer element box 16 is preferably flush with the first side surface 14 of the first building element 12 so that when the load transfer element 24 is pulled out of the load transfer element box 16, the load transfer element 24 protrudes from the first building element 12.

The load transfer box 16 also has a second end portion 18 located inside the first building element 12 and the load transfer box 16 preferably has an inner length which is at least as long as the length of the load transfer element 24 so that the entire load transfer element 24 may be pushed into the load transfer element box 16.

The second building element 30, which will normally, but not necessarily, be a vertically standing building element, comprises a support box 33 as shown in FIGS. 2-4. The support box 33 is preferably fixedly attached in the second building element 30, for example by the support box 33 being molded in during the production of the second building element 30.

Figure 5:
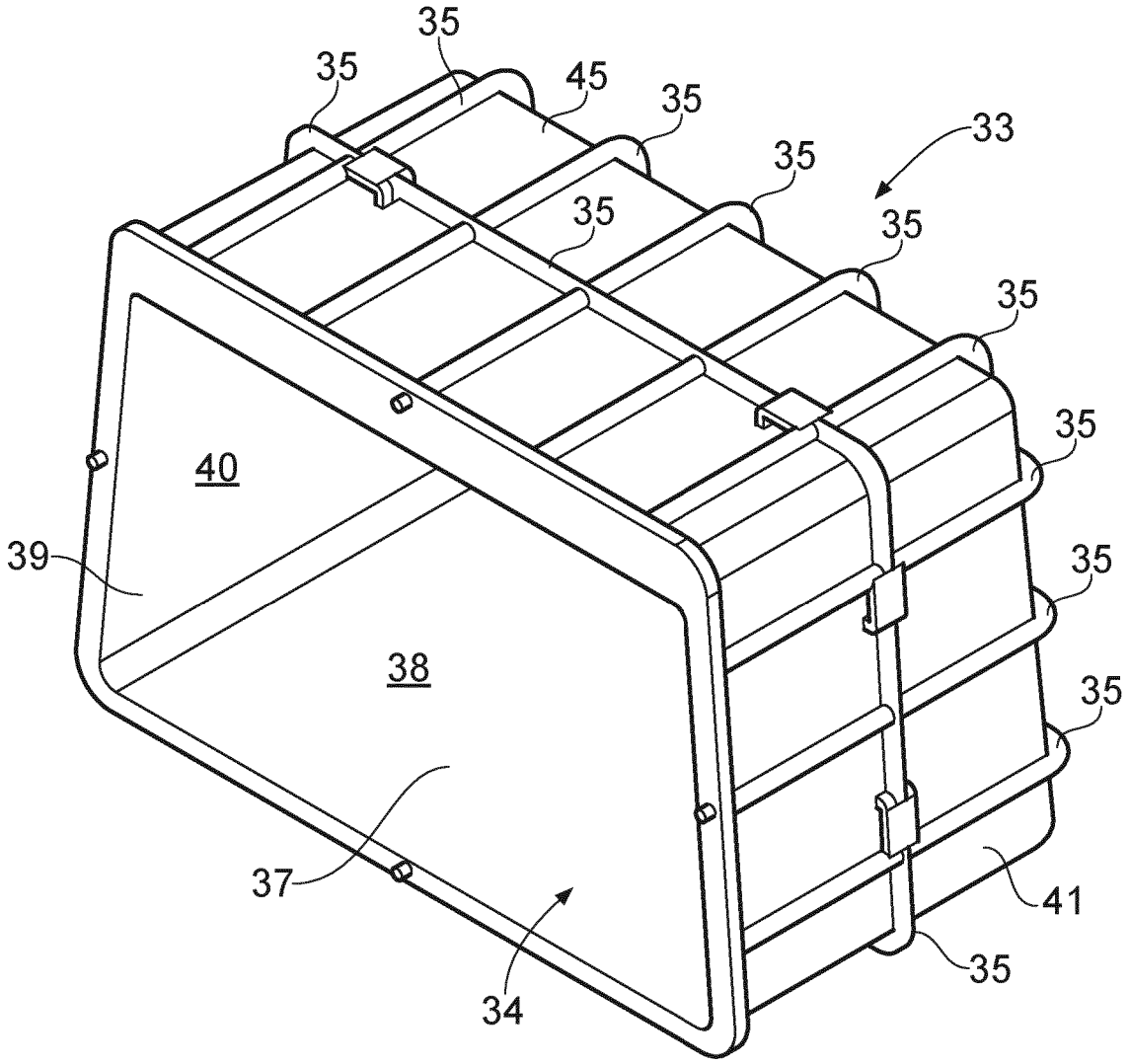
FIG. 5 is a perspective view of the support box into which the load transfer element projects.
Figure 6:
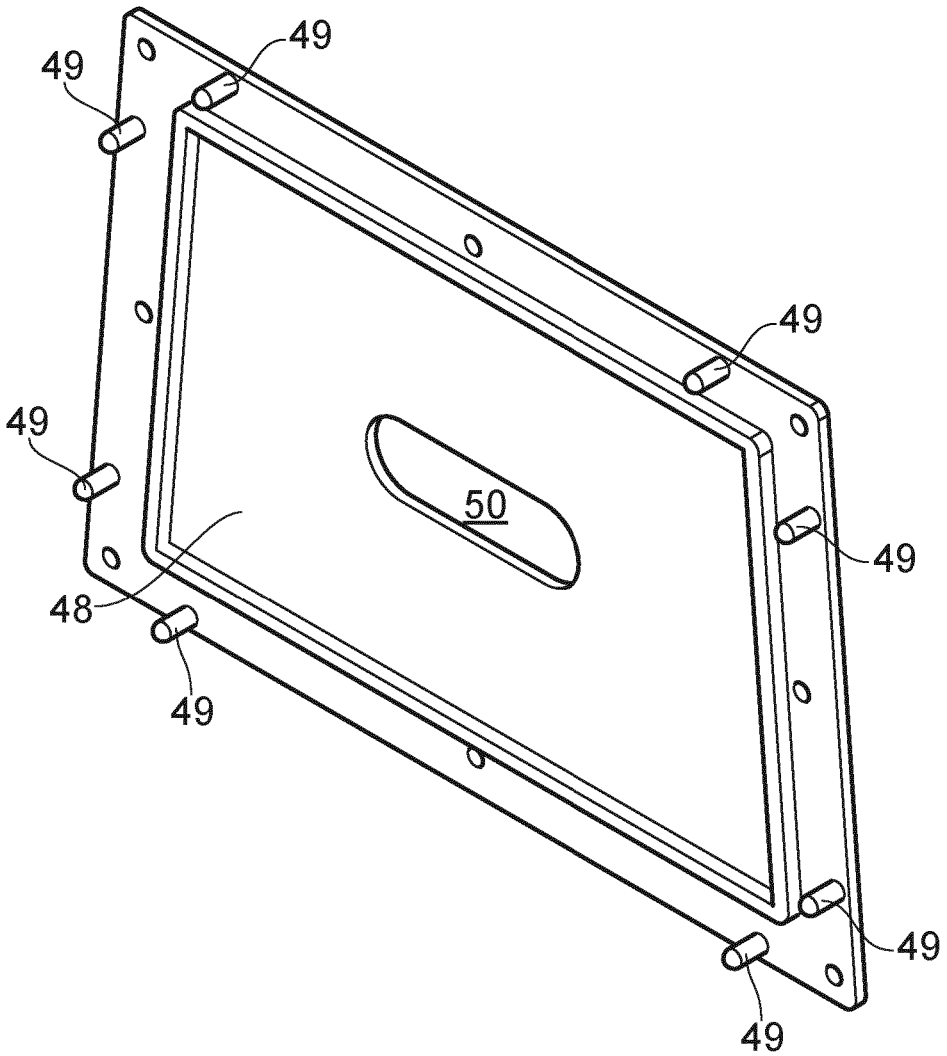
FIG. 6 shows a perspective view of a lid element for the support box.
Figure 8:
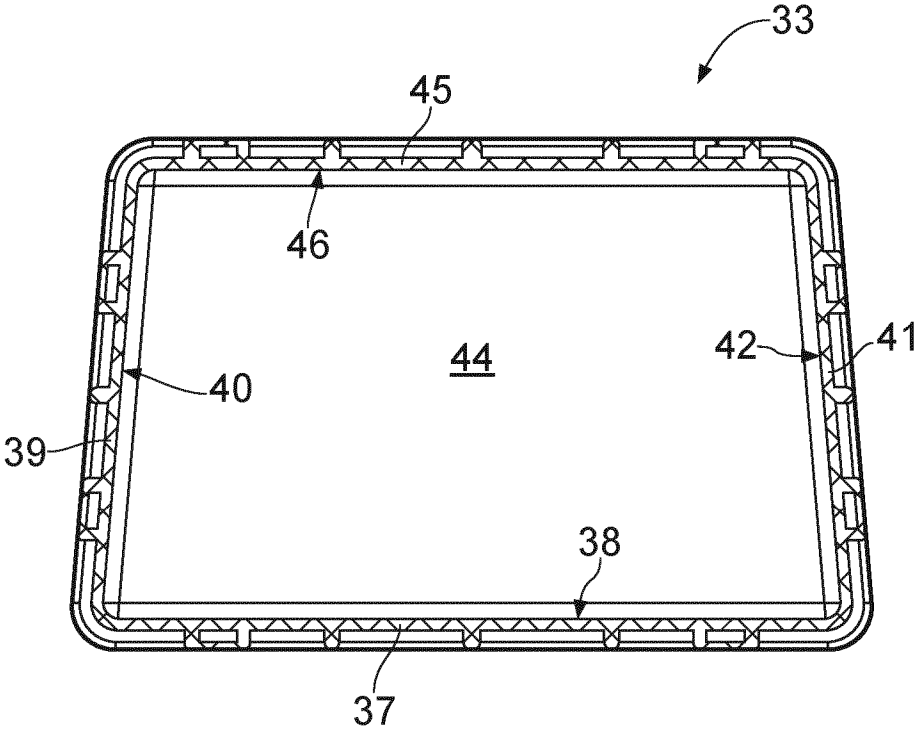
FIG. 8 shows a front view of the support box shown in FIG. 7.
Figure 7:
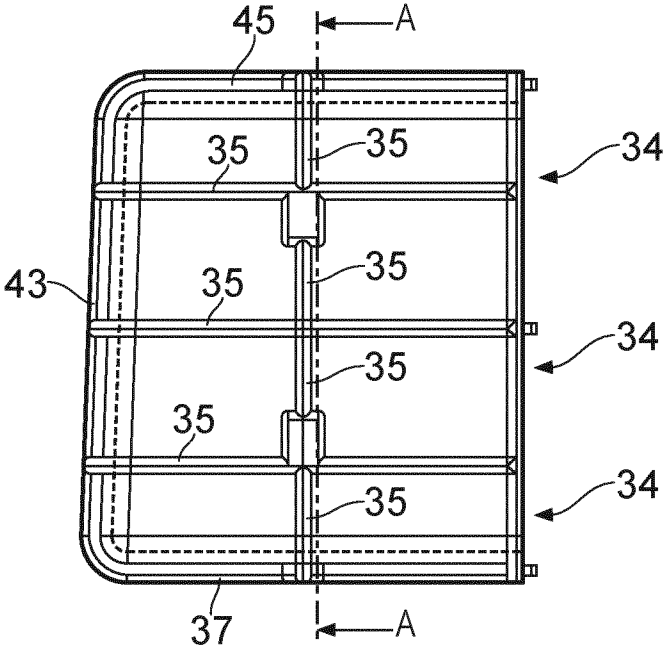
FIG. 7 shows a side view of the support box shown in FIG. 5.

As shown in FIGS. 5 and 7-8, the support box 33 is formed with a bottom wall 37 having an inner bottom wall surface 38, a first side wall 39 having a first inner surface 40, a second side wall 41 having a second inner surface 42, a third, or rear, side wall 43 having a third inner surface 44 and a roof wall 45 having an inner roof wall surface 46. As shown in FIG. 5, the support box 33 is preferably formed with one or more rib elements 35. The rib elements are preferably arranged on the outside of the support box 33 as indicated in the figures. The rib elements 35 give extra mechanical strength to the support box 33 and contribute to the support box 33 being securely fixed in its position in the second building element 30.

The support box 33 further has a support box opening 34 as indicated in FIG. 4, into which the load transfer element 24 projects, when the building connection 10 is completed. The support box opening 34 is preferably flush with the first side surface 31 of the second building element 30 facing the first building element 12.

The support box 33 may also comprise a lid 48 which may be attached to the support box 33 so that the support box opening 34 is covered, for example during production and/or transport of the second building element 30. The lid 48 may be provided with one or more fastening elements 49, such as pins or the like, which cooperate with complementary shaped fastening elements, such as openings or holes, on the support box 33. The lid 48 may also be formed with a gripping device 50 which may be used when the lid is to be removed. The gripping device 50 may, for example, be a hole in the lid 48 which is large enough for a person to insert one or more fingers through it.

Arranged on the inner bottom wall surface 38 of the support box 33 is a first sound-absorbing element 52. The first sound-absorbing element 52 is formed with a lower surface 53 abutting the inner bottom wall surface 38 of the support box 33 and an upper surface 54 facing the interior of the support box. Preferably, the first sound-absorbing element 52 covers substantially the entire inner bottom wall surface 38.

The first sound-absorbing element 52 may be made of different types of materials, for example of a rubber material, as long as it has the desired sound-absorbing properties and may withstand the mechanical stress due to the weight of the first building element 12 which the first sound-absorbing element 52 must absorb in an established building connection 10.

The first sound-absorbing element 52 is preferably formed with at least one, but preferably a plurality of protruding elements 55 projecting from the lower surface 53 and/or from the upper surface 54 of the first sound-absorbing element 52. In the embodiment shown in the FIGS. 3 and 4, the protruding elements 55 protrude from the lower surface 53. Between the protruding elements 55, space 56 is formed. When the first sound-absorbing element 52 is subjected to the load from the first building element 12 in a completed building connection 10, the first sound-absorbing element 52 could be compressed somewhat. The protruding elements 55 will then be able to compress and then expand out laterally and into the spaces 56. This means that the height of the first sound-absorbing element 52 will be reduced when it is loaded with the weight of the first building element 12 in a completed building connection 10.

Arranged on top of the first sound-absorbing element 52 is preferably a support plate 58. The support plate 58 preferably has the same design as the first sound-absorbing element 52 seen from above. The support plate 58 thus substantially covers the upper surface 54 of the first sound-absorbing element 52. The support plate may be made of different types of materials, for example a metal such as steel, or a plastic material which may withstand the load of the first building element 12 in in a completed building connection 10.

The connecting device 15 preferably also comprises a second sound-absorbing element 21. The second sound-absorbing element 21 is preferably arranged in a recess in the first side surface 14 of the first building element 12 facing the second building element 30. The recess in the first building element 12 preferably has a depth which substantially corresponds to the thickness of the second sound-absorbing element 21 so that a first surface 22 of the second sound-absorbing element 21 substantially aligns with the remains of the first side surface 14 of the first building element 12. The second sound-absorbing element may be made of a rubber material or another suitable material that has the desired sound-absorbing properties.

In the building connection 10 the first building element 12 is arranged at a distance from the second building element 30, i.e. there is a small gap 32 between the two building elements 12, 30. In the gap 32 a sealing element 27 is preferably arranged as indicated in FIGS. 3 and 4. The sealing element 27 has a general U-shape and lies at the bottom of the load transfer element 24 and extends up on the sides of the load transfer element 24 at least up to the same height as the roof wall 45 of the support box 33, but preferably slightly higher than this. The sealing element 27 preferably abuts in its entirety against the second sound-absorbing element 21. Alternatively, it may be arranged exactly in the transition between the first surface 22 of the second sound-absorbing element 21 and the first side surface 14 of the first building element 12 so that a filling material 61 arranged in the gap 32 between the two building elements 12, 30 does not come into contact with the first side surface 14 of the first building element 12.

In a completed building connection 10, the first building element 12 is connected to the second building element 30, and the load transfer element 24 is pulled out of the load transfer element box 16 so that it projects into the support box 33 as shown in FIGS. 2-4. When the load transfer element 24 is in its extended position and projects into the support box 33, a filling area 60 is formed as indicated in FIGS. 3 and 4. The filling area 60 thus comprises the area around the load transfer element 24 in the support box 33 and further outwards towards the second sound-absorbing element 21 in the gap 32 between the first building element 12 and the second building element 30. In the gap 32 between the two building elements 12, 30 the filling area 60 extends down to the sealing element 27 below the load transfer element 24, out to the sealing element 27 on the sides of the load transfer element 24, and in the smallest up to the roof wall 45 of the support box 33 at the top of the load transfer element 24 as indicated in FIGS. 3 and 4.

When the first building element 12 is to be attached to the second building element 30, the load transfer element 24 will be pushed into the load transfer element box 16 so that the first building element 12, such as for instance a landing or floor element, may be easily maneuvered into place between two or more vertically standing second building elements 30. When the first building element 12 is arranged in a straight position, the load transfer element 24 is pulled out of the load transfer element box 16 so that the load transfer element 24 projects into the support box 33, and the sealing element 27 is arranged on the underside and on to the sides of the load transfer element 24 so that the forming of the filling area 60 is completed. The filling area 60 is then filled with a filling material until the filling area 60 is completely filled with the filling material 61. When the filling material 61 hardens and stiffens, a building connection 10 is formed between a first building element 12 of concrete and a second building element 30 of concrete where sound transfer, and in particular step sound, between the two building elements 12, 30 is eliminated or at least reduced to a minimum.

When the filling material 61 is arranged in the filling area 60, an upper seal 28 may be arranged in the gap 32 between the first building element 12 and the second building element 30 preferably near the upper edge of the first side surface 14 of the first building element 12. The seal 28 preferably extends substantially along the entire width of the first building element 12. This will prevent liquid, sand, gravel and other material from accumulating in the gap 32. The seal 28 may, for example, be formed of a conventional silicone sealing material.

As mentioned above, the support box comprises a first side wall 39, a second side wall 41 and a third side wall 43. The first side wall 39 and/or second side wall 41 and/or third side wall 43 of the support box is preferably inclined relative to the bottom wall 37 and the bottom wall surface 38 of the bottom wall. This means that the angle between any inclined side walls is less than 90 degrees.

Furthermore, the first inner surface 40 of the first side wall 39 and/or the second inner surface 42 of the second side wall 41 and/or the third inner surface 44 of the third side wall 43 are preferably smooth, i.e. the inner surfaces 40, 42, 44 of the side walls have no shape for elements projecting from the inner surfaces 40, 42, 44 or any recesses in the inner surfaces 40, 42, 44 in which the filler material may adhere.

This means that when the filling material 61 in the support box 33 hardens/dries, and thus may shrink somewhat, the filling material 61 will not stick to the side surfaces 40, 42, 44 of the side walls.

It also means that when a load is transferred from the first building element 12 in an established building connection 10 to the second building element 30 via the load transfer element 24, and the first sound-absorbing element 52 is compressed a certain distance, the hardened filling material 61 will be able to move freely vertically in relative to the support box's plurality of side surfaces. When this happens, a small gap is formed between the filling material and the inner side surfaces 40, 42, 44 of the support box 33 as the inner side surfaces 40, 42, 44 are inclined, which also contributes to damping the sound transfer between the first building element 12 and the second building element 30.

The invention has now been described with reference to a non-limiting embodiment of the invention. However, one skilled in the art will appreciate that the invention, as explained above and shown in the figures, may be modified and that changes may be made within the scope of the invention as defined in the claims.

The invention claimed is:

1. A building connection comprising:

a first building element and a second building element arranged at a distance from each other, the first building element being connected to the second building element by at least one connecting device, wherein the at least one connecting device comprises:

a load transfer element arranged in the first building element, a support box molded into the second building element and comprising an inner bottom wall surface and a support box opening facing the first building element, a first sound-absorbing element arranged on the inner bottom wall surface of the support box, and a support plate which is arranged on top of the first sound-absorbing element, wherein the load transfer element protrudes from the first building element and into the support box through the support box opening, and wherein a filling area is molded with a filling material, and wherein the filling area comprises the support box and an area between the first building element and the second building element, and wherein the first sound-absorbing element comprises an upper surface and a lower surface, where the upper surface and/or the lower surface are formed with a plurality of separate, protruding elements, and open areas between the plurality of the protruding elements, wherein the protruding elements are arranged for being compressed and expand into the areas between the protruding elements.

2. The building connection according to claim 1, wherein the load transfer element is movably arranged in a load transfer element box, which load transfer element box is molded into the first building element.

3. The building connection according to claim 1, wherein the first sound-absorbing element covers substantially the entire inner bottom wall surface of the support box.

4. The building connection according to claim 1, wherein the first sound-absorbing element comprises an upper surface and that the support plate substantially covers the entire upper surface of the first sound-absorbing element.

5. The building connection according to claim 1, wherein the area between the plurality of protruding elements is large enough that there is room for the plurality of protruding elements to expand outwards when the first sound-absorbing element is subjected to load from the load transfer element via the filling material and the support plate.

6. The building connection according to claim 1, wherein the first sound-absorbing element is formed in a rubber material.

7. The building connection according to claim 1, wherein the load transfer element is arranged in the support box surrounded by filling material.

8. The building connection according to claim 1, wherein the support box is formed with a plurality of side walls which are inclined relative to the inner bottom wall surface.

9. The building connection according to claim 8, wherein the side walls of the support box are formed with inner side surfaces which are smooth.

10. The building connection according to claim 1, wherein the connecting device comprises a second sound absorbing element arranged in a first end surface (14) of the first building element facing the second building element, which second sound absorbing element encloses an opening in the load transfer element box from which the load transfer element projects, and which extends into the first end surface so that the second sound-absorbing element at least covers the filling area abutting against the first building element.

11. The building connection according to claim 1, wherein the building connection comprises a sealing element arranged between and abutting against the first building element and the second building element, and extending at least on the underside of and up on the sides of the opening of the load transfer element box.

12. Use of a building connection according to claim 1, wherein the first building element is a landing and the second building element is a wall.

13. Use of a building connection according to claim 1, wherein the first building element is a floor element and the second building element is a wall.

* * * * *